US005272979A

United States Patent [19]

Lewis et al.

[11] Patent Number: 5,272,979

[45] Date of Patent: Dec. 28, 1993

[54] PLASMA-JET IMAGING APPARATUS AND METHOD

[75] Inventors: Thomas E. Lewis, E. Hampstead; Richard A. Williams, Hampstead; John P. Gardiner; John F. Kline, both of Londonderry, all of N.H.

[73] Assignee: Presstek, Inc., Hudson, N.H.

[21] Appl. No.: 859,407

[22] Filed: Apr. 30, 1992

Related U.S. Application Data

[63] Continuation-in-part of Ser. No. 554,089, Jul. 17, 1990, Pat. No. 5,062,364, which is a continuation of Ser. No. 329,979, Mar. 29, 1989, abandoned.

[51] Int. Cl.[5] ..... B41C 1/05; B41C 1/10

[52] U.S. Cl. ..... 101/467; 346/159

[58] Field of Search ..... 101/467, 453, 483; 346/159

[56] References Cited

U.S. PATENT DOCUMENTS

| | | | |
|---|---|---|---|
| 3,978,492 | 8/1976 | Simm | 346/159 |
| 4,082,902 | 4/1978 | Suzuki et al. | 101/467 |
| 4,292,397 | 9/1981 | Takeuchi et al. | 101/456 |
| 4,596,733 | 6/1986 | Cohen et al. | 101/453 |
| 4,718,340 | 1/1988 | Love, III | 101/467 |
| 4,727,388 | 2/1988 | Sheridon et al. | 346/159 |
| 4,911,075 | 3/1990 | Lewis et al. | 101/453 |
| 5,062,364 | 11/1991 | Lewis et al. | 101/467 |
| 5,109,771 | 5/1992 | Lewis et al. | 101/453 |
| 5,165,345 | 11/1992 | Lewis et al. | 101/453 |
| 5,188,032 | 2/1993 | Lewis et al. | 101/453 |
| 5,235,914 | 8/1993 | Williams et al. | 101/467 |

FOREIGN PATENT DOCUMENTS 0130028 1/1985 European Pat. Off. .

*Primary Examiner*—Eugene H. Eickholt
*Attorney, Agent, or Firm*—Cesari and McKenna

[57] ABSTRACT

A method of and apparatus for imaging a lithographic plate having a printing surface by exposing the printing surface to plasma jet discharges between the plate and a plasma jet nozzle spaced close to the printing surface of the plate. These plasma jet discharges are sufficient to ablate or otherwise transform one or more layers of the printing surface, thereby changing the affinity of the printing surface for ink and/or water at the points thereof exposed to the discharges so as to produce image spots on the plate.

36 Claims, 3 Drawing Sheets

PLASMA-JET IMAGING APPARATUS AND METHOD

This application is a continuation-in-part of Ser. No. 07/554,089, filed Jul. 17, 1990, now U.S. Pat. No. 5,062,364 is itself a continuation of Ser. No. 07/329,979, filed Mar. 29, 1989, now abandoned.

BACKGROUND OF THE INVENTION

A. Field of the Invention

This invention relates to offset lithography and printing generally. It relates more specifically to method and apparatus for imaging lithographic and other planographic plates.

B. Description of the Related Art

There are a variety of known ways to print hard copy in black and white and in color. The traditional techniques include letterpress printing, rotogravure printing and offset printing. These conventional printing processes produce high quality copies. However, when only a limited number of copies are required, the copies are relatively expensive. In the case of letterpress and gravure printing, the major expense results from the fact that the image has to be cut or etched into the plate using expensive photographic masking and chemical etching techniques.

Plates are also required in offset lithography. However, the plates are in the form of mats or films which are relatively inexpensive to make. The image is present on the plate or mat as hydrophilic and hydrophobic (and oleophilic, or ink-receptive) surface areas. In wet lithography, water and then ink are applied to the surface of the plate. Water tends to adhere to the hydrophilic or water-receptive areas of the plate creating a thin film of water there which does not accept ink. The ink does adhere to the hydrophobic areas of the plate and those inked areas, usually corresponding to the printed areas of the original document, are transferred to a relatively soft blanket cylinder and, from there, to the paper or other recording medium brought into contact with the surface of the blanket cylinder by an impression cylinder.

In dry lithography, application of a fountain or dampening solution to the plate prior to inking is unnecessary. Instead, the non-image material of dry plates is itself sufficiently ink-repellent that ink simply fails to adhere to such material.

Most conventional offset plates are produced photographically. In a typical negative-working, subtractive process, the original document is photographed to produce a photographic negative. This negative, or "mask", is placed on an aluminum plate having a water-receptive oxide surface that is coated with a photopolymer. Upon being exposed to light through the negative, the areas of the coating that received light (corresponding to the dark or printed areas of the original) cure to a durable oleophilic or ink-receptive state. The plate is then subjected to a developing process which removes the noncured areas of the coating that did not receive light (corresponding to the light or background areas of the original). The resultant plate now carries a positive or direct image of the original document.

If a press is to print in more than one color, a separate printing plate corresponding to each color is required, each of which is usually made photographically as aforesaid. In addition to preparing the appropriate plates for the different colors, the plates must be mounted properly on the print cylinders in the press and the angular positions of the cylinders coordinated so that the color components printed by the different cylinders will be in register on the printed copies.

The development of lasers has simplified the production of lithographic plates to some extent. Instead of applying the original image photographically to the photoresist-coated printing plate as above, an original document or picture is scanned line-by-line by an optical scanner which develops therefrom strings of picture signals, one for each color. These signals are then used to control a laser plotter that writes on and thus exposes the photoresist coating on the lithographic plate to cure the coating in those areas which receive light. That plate is then developed in the usual way by removing the unexposed areas of the coating to create a direct image on the plate for that color. Thus, it is still necessary to chemically etch each plate in order to create an image on that plate.

A number of designers have attempted to automate the platemaking process by etching digitally stored image data onto a blank lithography plate. One well-known method of accomplishing this is known as electro-erosion. The type of plate suitable for imaging in this fashion has an eleophilic plastic substrate, e.g., Mylar plastic film, having a thin coating of aluminum metal with an overcoating of conductive graphite; the latter acts as a lubricant to minimize scratching of the aluminum coating. A stylus electrode in contact with the graphite surface coating is caused to move across the surface of the plate and is pulsed in accordance with incoming picture signals. The resultant current flow between the electrode and the thin metal coating is, by design, large enough to erode away the thin metal coating and the overlying conductive graphite surface coating, thereby exposing the underlying ink-receptive plastic substrate on the areas of the plate corresponding to the printed portions of the original document.

This method of making lithographic plates suffers from the disadvantage that the described electro-erosion process only works on plates whose conductive surface coatings are very thin; furthermore, the stylus electrode which contacts the surface of the plate still sometimes scratches the plate. This degrades the image being written onto the plate because the scratches constitute inadvertent or unwanted image areas on the plate that print similarly unwanted marks on the copies.

An alternative to the electro-erosion process is described in U.S. Pat. No. 4,718,340. This reference describes use of spark-discharge apparatus that do not make contact with the plate, thereby avoiding the above-noted problem of surface scratching. Because the disclosed apparatus operate at relatively low power levels, the plates discussed in this reference all have hydrophilic metal substrates coated with an oleophilic surface layer, the latter being ablated during the imaging process. This places significant limitations on the ability to design plates that will perform both durably and effectively. For example, to be suitable for use with the disclosed apparatus, the oleophilic surface layer must be fragile enough to decompose upon exposure to relatively low-energy sparks, a characteristic that would also result in limited on-press durability. Furthermore, the approach described in this patent would not be suitable for production of typical dry plates, which feature oleophobic silicone surface coatings that could not usefully be employed in conjunction with a hydrophilic substrate, in addition to being too resilient for removal at low power levels.

Another example of non-contact platemaking is described in published European Patent Application EP 0167352, which involves a method for generating a latent image on a blank plate using low-current electrical discharges. These discharges do not remove or otherwise alter the physical characteristics of the substrate. Rather, the apparatus appears to produce the same chemical changes in the plate-surface material that would conventionally be produced by exposure to actinic radiation, as described above. Once again, the need for chemical response to the low-power discharges imposes significant limitations on the plate constructions that can be imaged with this type of apparatus.

Other designers have attempted to use more powerful lasers to write images on blank plates. However, the use of such lasers for this purpose has not been entirely satisfactory because the photoresist coating on the plate must be compatible with the particular laser, a requirement that limits the choice of coating materials. Also, the pulsing frequencies of some lasers used for this purpose are so low as to render the time required to produce a halftone image on the plate unacceptably long.

There have also been some attempts to use scanning E-beam apparatus to etch away the surface coatings on plates used for printing. However, such machines are very expensive. In addition, they require that the workpiece, i.e., the plate, be maintained in a complete vacuum, making such apparatus impractical for day-to-day use in a printing facility.

We are also aware of a press system that images a lithographic plate while the plate is actually mounted on the print cylinder in the press. The cylindrical surface of the plate, treated to render it either oleophilic or hydrophilic, is written on by an ink jetter arranged to scan over the surface of the plate. The ink jetter is controlled so as to deposit on the plate surface a thermoplastic image-forming resin or material that has a desired affinity for the printing ink being used to print the copies. For example, the image-forming material may be attractive to the printing ink so that the ink adheres to the plate in the areas thereof where the image-forming material is present but is repelled by the "wash" used in the press to prevent inking of the background areas of the image on the plate.

While that prior system may be satisfactory for some applications, it is not always possible to provide thermoplastic image-forming material that is suitable for jetting and also has the desired affinity (philic or phobic) for all of the inks commonly used for making lithographic copies. Also, ink jet printers are generally unable to produce small enough ink dots to allow the production of smooth continuous tones on the printed copies, i.e. the resolution is not high enough.

Thus, despite all of the aforementioned efforts to improve different aspects of lithographic plate production and offset printing, significant performance and operational limitations remain.

DESCRIPTION OF THE INVENTION

A. Objects of the Invention

Accordingly, the present invention aims to provide an improved method for imaging lithographic printing plates.

Another object of the invention is to provide a method of imaging lithographic plates which can be practiced while the plate is mounted in a press.

Still another object of the invention is to provide a method for writing both positive and negative or background images on lithographic plates.

Still another object of the invention is to provide such a method which can be used to apply images to a variety of different kinds of lithographic plates.

A further object of the invention is to provide a method of producing on lithographic plates half tone images with variable dot sizes.

A further object of the invention is to provide improved apparatus for imaging lithographic plates using plasma discharges.

Another object of the invention is to provide apparatus of this type which applies the images to the plates efficiently and with a minimum consumption of power.

Another object of the invention is to provide an imaging apparatus that can generate a photographic master without having to chemically develop the image on the master.

A further object of the invention is to provide an apparatus of this type capable of both indirect writing on certain polymer coated plates and direct writing on silicone-based plates.

Still another object of the invention is to provide such apparatus which lends itself to control by incoming digital data representing an original document or picture.

Other objects will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts which are adapted to effect such steps, all as exemplified in the following detailed description, and the scope of the invention will be indicated in the claims.

B. Brief Summary of the Invention

In accordance with the present invention, images are applied to a lithographic printing plate by altering or ablating the physical surface structure of the plate at selected points or areas of the plate using a non-contacting writing head, which scans over the surface of the plate and is controlled by incoming picture signals corresponding to the original document or picture being copied. The writing head comprises one or more precisely positioned and focused plasma-jet sources, each of which uses an electric arc to ionize a working gas into a plasma state. As used herein, a "plasma" refers to an assembly of ions, electrons, neutral atoms and molecules in which particle motion is governed primarily by electromagnetic forces, and the degree of ionization exceeds 5%.

Short duration, high voltage pulses are used to produce the arc so that the plasma-jet discharges are also of short duration, and travel a substantially straight-line path from the discharge source to the point on the plate directly opposite. Each such discharge creates, at the point of contact on the surface of the plate, a precisely controlled and positioned intense heat zone.

In response to the incoming picture signals and ancillary data keyed in by the operator such as dot size, screen angle, screen mesh, etc. and merged with the picture signals, high voltage pulses having precisely controlled voltage and current profiles are applied to the plasma-jet source electrode or multiple such sources to produce precisely positioned and defined plasma-jet or plasma-arc discharges to the plate which physically transform selected points or areas of the plate surface to render them either receptive or non-receptive to the printing ink that will be applied to the plate to make the printed copies. By "transform" we mean either ablation of a surface layer or significant disruption of physical structure with loss of material. Such disruption distorts the crystallinity of the surface and, we believe, results in pore spaces being filled in to alter the surface's hydrophilicity.

Preferably, each plasma-jet source operates in a so-called jet transfer mode wherein the arc and plasma jet extend from a nozzle in the source to the workpiece being heated, in this case, the lithographic plate. Plasma-arc discharges operate in a like manner in an atmosphere of working gas suitable for conductive arcs.

Lithographic plates are made ink receptive or oleophilic initially by providing them with surface areas consisting of plastic materials to which oil- and rubber-based inks adhere readily. On the other hand, plates are made ink repellent or oleophobic initially by providing them with low-surface-energy coatings to which inks cannot adhere. As will be seen later, certain ones of these plate embodiments are suitable for wet printing, others are better suited for dry printing.

The present apparatus can write images on these different lithographic plates having either ink-receptive or ink-repellent surfaces. In other words, if the plate surface is repellent initially, our apparatus will write a positive image on the plate by rendering ink receptive or oleophilic the points or areas of the plate surface corresponding to the printed portion of the original document. On the other hand, if the plate surface is ink receptive or oleophilic initially, the apparatus will apply a background or negative image to the plate surface by rendering hydrophilic the points or areas of that surface corresponding to the background or non-printed portion of the original document. Direct or positive writing is usually preferred since the amount of plate surface area that must be transformed is less because most documents have less printed areas than non-printed areas.

The plate imaging apparatus incorporating our invention is preferably implemented as a scanner or plotter whose writing head consists of one or more plasma-jet sources positioned over the working surface of the lithographic plate and moved relative to the plate so as to collectively scan the plate surface. Each plasma-jet source or electrode is energized by an incoming stream of picture signals which is an electronic representation of an original document or picture. The signals can originate from any suitable source such as an optical scanner, a disk or tape reader, a computer, telecommunication apparatus, electronic pre-press system, etc. These signals are formatted so that the apparatus' plasma-jet source or sources writes a positive or negative image onto the surface of the lithographic plate that corresponds to the original document.

If the lithographic plates being imaged by our apparatus are flat, then the plasma-jet source or sources may be incorporated into a flat bed scanner or plotter. Usually, however, such plates are designed to be mounted to a print cylinder. Accordingly, for most applications, the source (or sources) is incorporated as a writing head into a so-called drum scanner or plotter with the lithographic plate being mounted to the cylindrical surface of the drum. Actually, as we shall show, our invention can be practiced on a lithographic plate already mounted in a press to apply an image to that plate in situ. In this application, then, the print cylinder itself may comprise the drum component of the scanner or plotter.

To achieve the requisite relative motion between the writing head and the cylindrical plate, the plate can be rotated about its axis and the head moved parallel to the rotation axis so that the plate is scanned circumferentially with the image on the plate "growing" in the axial direction. Alternatively, the writing head can move parallel to the drum axis and after each pass of the head, the drum can be incremented angularly so that the image on the plate grows circumferentially. In both cases, after a complete scan by the head, an image corresponding to the original document or picture will have been applied to the surface of the printing plate.

As the writing head traverses the plate, it is maintained at a small distance above the plate surface. In addition to the working gas that is introduced into the writing head, air or other gas blends under pressure may also be delivered between the writing assembly and the plate to provide oxygen or other reagents for the etching process and to expel residue from the etching area. That gas flow also provides a cushion for the writing head to prevent its contacting and, possibly, scratching the plate surface. In response to the incoming picture signals, which usually represent a halftone or screened image, each plasma-jet source is pulsed or not pulsed at selected points in the scan depending upon whether, according to the incoming data, that source is to write or not write at these locations.

Each time a source is pulsed, there is an accompanying plasma discharge between the plasma-jet source and the particular point on the plate opposite to that source. Several features assure that the discharge follows a substantially straight-line path from the plasma-jet source to the plate surface—a critical performance criterion, since a high degree of accuracy is required to produce an acceptable lithographic plate. First, we utilize much higher discharge power than that associated with prior-art systems, thereby producing a high field gradient that encourages straight-line travel. This can be explained as follows. The strongest part of the field on the plate, to which the discharge is most strongly attracted, occurs at the point precisely opposite the discharge source. However, the strength of the field at this point must be sufficiently greater than the strength at any other point to overcome the inherently random nature of the discharge. The stronger the gradient, the faster the field strength diminishes as the path from source to plate deviates from the normal. Accordingly, high discharge power creates a strong gradient, which, in turn, favors straight-line discharge travel by emphasizing the recession of the plate field strength in all directions away from the normal.

Second, the plasma-jet source is precisely configured to provide a highly focused emission. The electrode is positioned behind an ejection nozzle, thereby eliminating the electrode as a possible source of interference with plasma flow, and preferably terminates in a pointed tip to enhance the focus of the charge as it builds up. The nozzle has a precise diameter and length and is supplied with working gas; this can be any gas that is not too strongly electronegative, such as argon, neon, xenon, krypton, or helium (radon is usable but not practical due to its toxicity) or nitrogen. The working gas can also include one or more electronegative gases (such as oxygen) as additives; however, in order to maintain adequately small breakdown times, these should not constitute a major component of the working gas. Accordingly, air (preferably moist) can also be employed as a working gas. The working gas is delivered at a precisely controlled pressure to provide a laminar-flow (non-turbulent) discharge of cylindrical cross-section through the nozzle and onto the plate. The spark, plasma and accompanying heat transform the surface of the plate in a controllable fashion to produce an image-forming spot or dot on the plate surface which is precisely defined in terms of shape and depth of penetration into the plate.

The pulse duration, current or voltage controlling the plasma jet at each source may be varied to produce a variable dot on the plate. Also, the polarity of the voltage applied to the plasma-jet assembly may be made positive or negative depending upon the nature of the plate surface to be affected by the writing, i.e., depending upon whether ions need to be pulled from or repelled to the surface of the plate at each image point in order to facilitate transformation of the surface at that point. In this way, image spots can be written onto the plate surface that have diameters in the order of 0.005 inch all the way down to 0.0001 inch.

After a complete scan of the plate, then, the apparatus will have applied a complete screened image to the plate in the form of a multiplicity of surface spots or dots which are different in their affinity for ink from the portions of the plate surface not exposed to the plasma discharges from the scanning electrode.

Thus, using our method and apparatus, high-quality images can be applied to lithographic plates which have a variety of different plate surfaces suitable for either dry or wet offset printing. In particular, our use of high-power discharges permits imaging of plates composed of refractory materials. By employing strong surface and substrate layers, we are able to produce lithographic plates that offer longer performance lifetimes than those proposed in connection with the prior-art spark-discharge systems.

With the present invention, the image is applied to the plate relatively quickly and efficiently and in a precisely controlled manner so that the image on the plate is an accurate representation of the printing on the original document. A lithographic plate can be imaged while it is mounted in its press, thereby reducing set up time considerably. An even greater reduction in setup time results if the invention is practiced on plates mounted in a color press, because correct color registration between the plates on the various print cylinders can be accomplished electronically rather than manually by controlling the timings of the input data applied to the plasma jet or electrode sources that write the images on the plates.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE PREFERRED EMBODIMENTS

Figure 1:
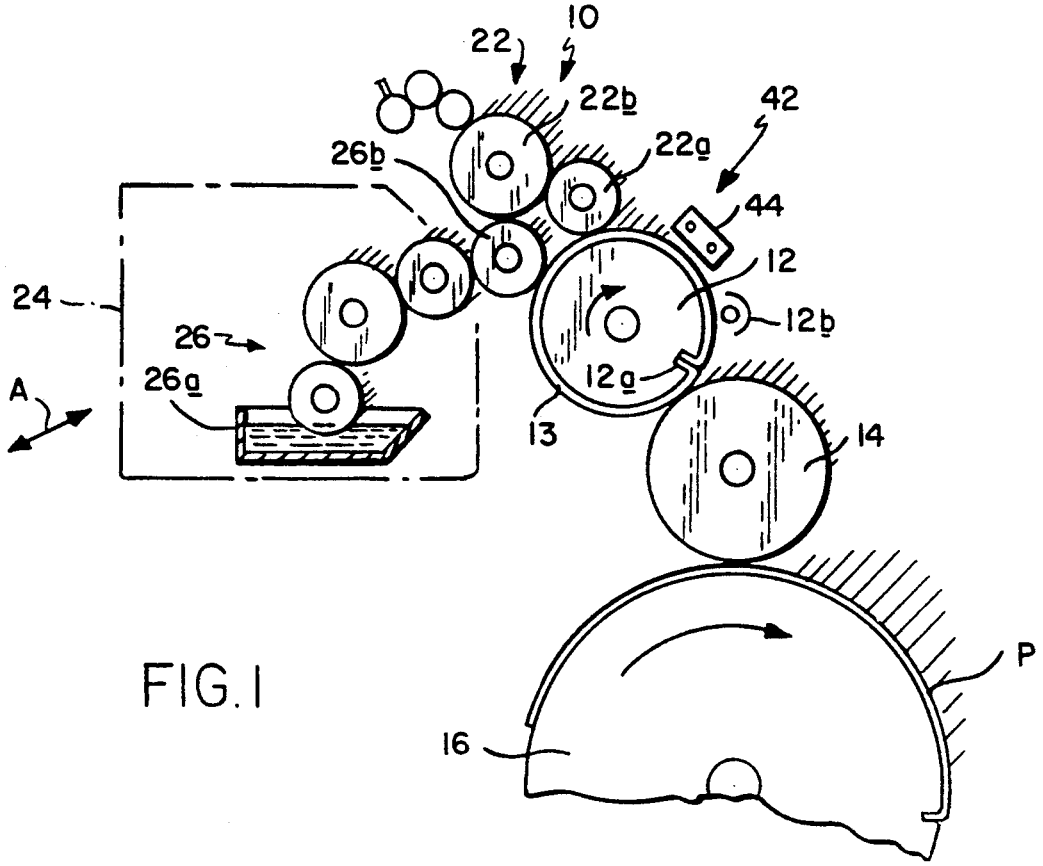
FIG. 1 is a diagrammatic view of an offset press incorporating a lithographic printing plate made in accordance with this invention.

Refer first to FIG. 1 of the drawings which shows a more or less conventional offset press shown generally at 10 which can print copies using lithographic plates made in accordance with this invention.

Press 10 includes a print cylinder or drum 12 around which is wrapped a lithographic plate 13 whose opposite edge margins are secured to the plate by a conventional clamping mechanism 12*a* incorporated into cylinder 12. Cylinder 12, or more precisely the plate 13 thereon, contacts the surface of a blanket cylinder 14 which, in turn, rotates in contact with a large-diameter impression cylinder 16. The paper sheet P to be printed on is mounted to the surface of cylinder 16 so that it passes through the nip between cylinders 14 and 16 before being discharged to the exit end of the press 10. Ink for inking plate 13 is delivered by an ink train 22, the lowermost roll 22*a* of which is in rolling engagement with plate 13 when press 10 is printing. As is customary in presses of this type, the various cylinders are all geared together so that they are driven in unison by a single drive motor. This ink train may be used on a single color press as well as on a multiple color press.

The illustrated press 10 is capable of wet as well as dry printing. Accordingly, it includes a conventional dampening or water fountain assembly 24 which is movable toward and away from drum 12 in the directions indicated by arrow A in FIG. 1 between active and inactive positions. Assembly 24 includes a conventional water train shown generally at 26 which conveys water from a tray 26*a* to a roller 26*b* which, when the dampening assembly is active, is in rolling engagement with plate 13 and the intermediate roller 22*b* of ink train 22 as shown in FIG. 1.

Figure 4A:
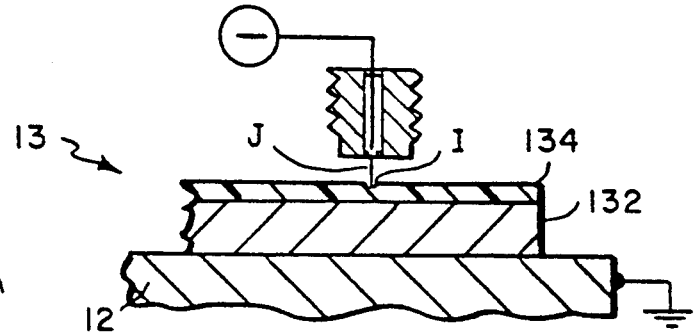
FIGS. 4A and 4B are enlarged sectional views showing lithographic plates imaged in accordance with our invention.

When press 10 is operating in its dry printing mode, the dampening assembly 24 is inactive so that roller 26*b* is retracted from roller 22*b* and the plate as shown in phantom in FIG. 1 and no water is applied to the plate. The lithographic plate 13 on cylinder 12, which is described in more detail in connection with FIG. 4A, is designed for such dry printing. It has a surface which is oleophobic or non-receptive to ink except in those areas that have been written on or imaged to make them oleophilic or receptive to ink. As the cylinder 12 rotates, the plate is contacted by the ink-coated roller 22*a* of ink train 22. The areas of the plate surface that have been written on and thus made oleophilic pick up ink from roller 22*a*. Those areas of the plate surface not written on receive no ink. Thus, after one revolution of cylinder 12, the image written on the plate will have been inked or developed. That image is then transferred to the blanket cylinder 14, and finally to the paper sheet P which is pressed into contact with the blanket cylinder.

When press 10 is operating in its wet printing mode, the dampening assembly 24 is active so that the water roller 26*b* contacts ink roller 22*b* and the surface of the plate 13 as shown in FIG. 1. The lithographic plate in this case is designed for wet printing. See, for example, plate 152 in FIG. 4B. It has a surface which is ink-receptive or oleophilic except in the areas thereof which have been written on to make them hydrophilic. Those areas, which correspond to the unprinted areas of the original document, accept water. In this mode of operation, as the cylinder 12 rotates (clockwise in FIG. 1), water and ink are presented to the surface of plate 13 by the rolls 26*b* and 22*a*, respectively. The water adheres to the hydrophilic areas of that surface corresponding to the background of the original document and those areas, being coated with water, do not pick up ink from roller 22*a*. On the other hand, the oleophilic areas of the plate surface which have not been wetted by roller 26 pick up ink from roller 22*a*, again forming an inked image on the surface of the plate. As before, that image is transferred via blanket roller 14 to the paper sheet P on cylinder 16.

Figure 2:
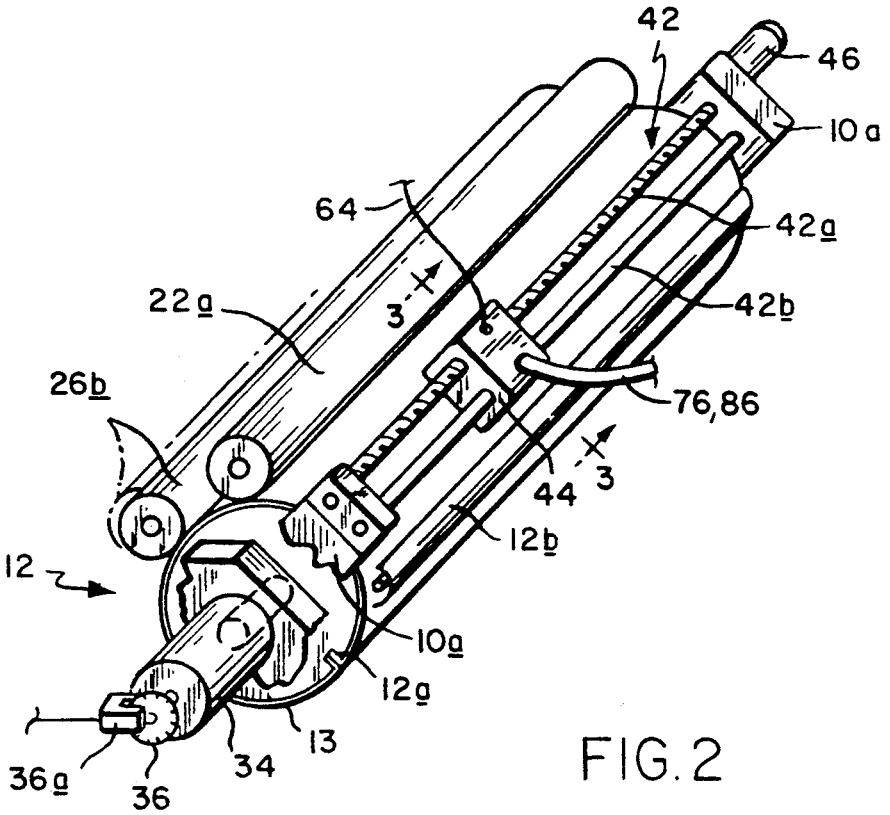
FIG. 2 is an isometric view on a larger scale showing in greater detail the print cylinder portion of the FIG. 1 press.

While the image to be applied to the lithographic plate 13 can be written onto the plate while the plate is "off press", our invention lends itself to imaging the plate when the plate is mounted on the print cylinder 12; the apparatus for accomplishing this will now be described. As shown in FIG. 2, the print cylinder 12 is rotatively supported by the press frame 10*a* and rotated by a standard electric motor 34 or other conventional means. The angular position of cylinder 12 is monitored by conventional means such as a shaft encoder 36 that rotates with the motor armature and associated detector 36*a*. If higher resolution is needed, the angular position of the large diameter impression cylinder 16 may be monitored by a suitable magnetic detector that detects the teeth of the circumferential drive gear on that cylinder which gear meshes with a similar gear on the print cylinder to rotate that cylinder.

Also supported on frame 10*a* adjacent to cylinder 12 is a writing head assembly shown generally at 42. This assembly comprises a lead screw 42*a* whose opposite ends are rotatively supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a step motor 46, carriage 44 is moved axially with respect to print cylinder 12.

The cylinder drive motor 34 and step motor 46 are operated in synchronism by a controller 50 (see FIG. 3), which also receives signals from detector 36*a*, so that as the drum rotates, the carriage 44 moves axially along the drum with the controller "knowing" the instantaneous relative position of the carriage and cylinder at any given moment. The control circuitry required to accomplish this is already very well-known in the scanner and plotter art.

Numerous variations on this general construction are possible. For example, a multicolor press can include multiple printing stations arranged in sequence, each station including a plate cylinder and a blanket cylinder, so that the paper sheet is guided past each blanket cylinder by a linear conveyancing mechanism. More than one plate cylinder can also "share" a single blanket cylinder. Alternatively, the printing stations can surround a single impression cylinder, as described in U.S. Pat. No. 4,936,211; again, more than one plate cylinder can be associated with a single blanket cylinder.

Figure 3:
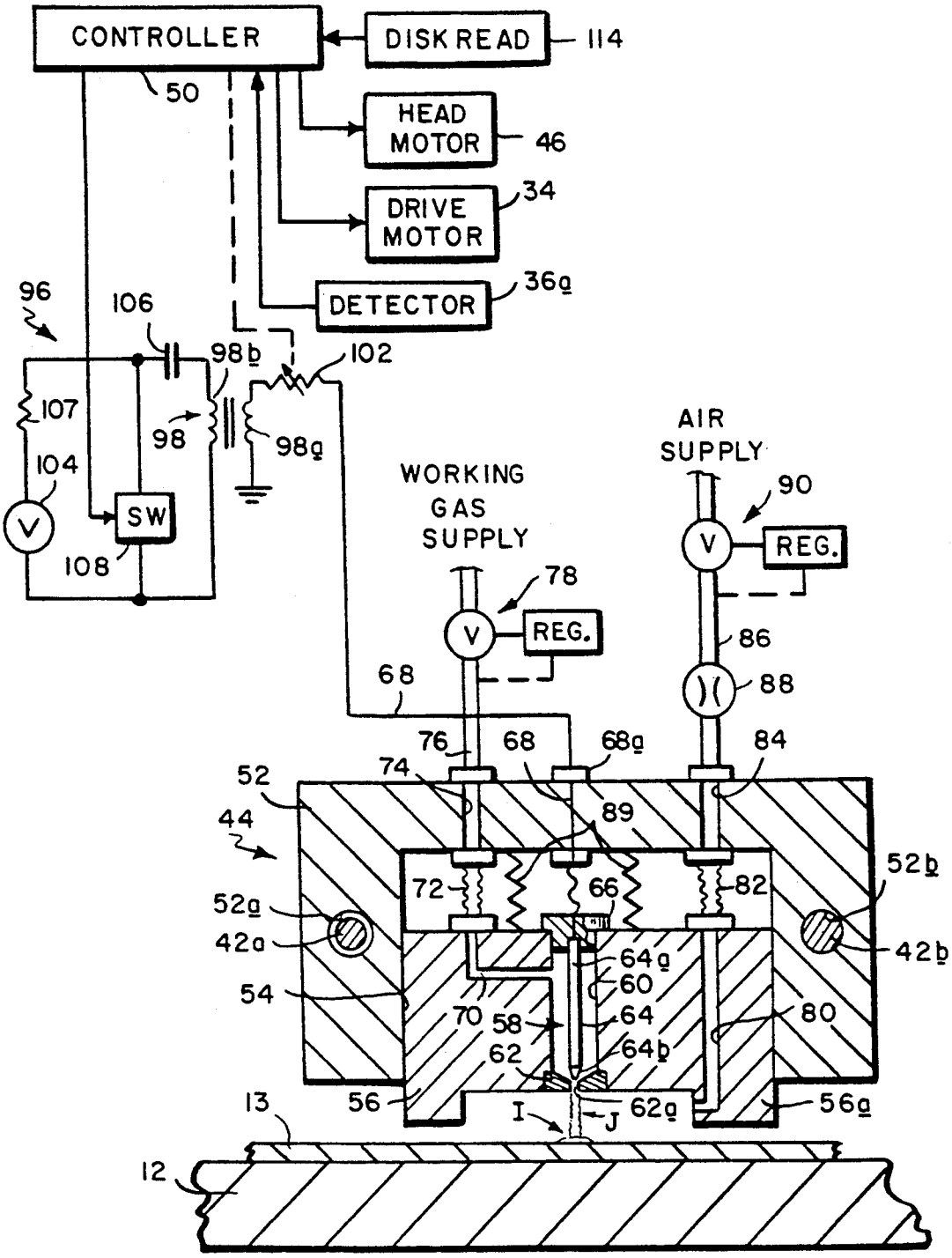
FIG. 3 is a sectional view taken along line 3—3 of FIG. 2 on a larger scale showing the writing head that applies an image to the surface of the FIG. 2 print cylinder, with the associated electrical components being represented in a block diagram.

Refer now to FIG. 3 which depicts an illustrative embodiment of carriage 44. It includes a block 52 having a threaded opening 52*a* for threadably receiving the lead screw 42*a* and a second parallel opening 52*b* for slidably receiving the guide rod 42*b*. A bore or recess 54 extends in from the underside of block 52 for slidably receiving a writing head 56 made of a suitable rigid electrical insulating material that supports a plasma-jet source. The illustrated head has only one such source 58 and is, therefore, capable of imaging only one point on plate 13 at a time. It should be understood, however, that the head may carry a plurality of such sources in which case it would image a corresponding plurality of points on the plate simultaneously.

Source 58 comprises a vertical passage 60 that extends down through head 56. The lower end of passage 60 is partially closed by a nozzle 62 made of a refractory material such as ceramic, ruby or sapphire. Centered on the axis of passage 60 is an electrode 64 whose upper end 64*a* is supported by a conductive socket 66 plugged into the upper end of passage 60. Electrode 64 is made of a refractory metal such as tungsten, nichrome or the like capable of withstanding erosion due to spark discharges from the electrode. The lower end or tip 64*b* of the electrode is preferably pointed and is shown as extending slightly into the nozzle orifice 62*a*; this contrasts with some of the prior-art systems, which utilize annular electrodes. In some cases, however, the electrode may be shorter so that its tip 64*b* is spaced above the nozzle 62. An insulated conductor 68 connects socket 66 to a terminal 68*a* at the top of block 52.

A small gas passage 70 extends from the top of head 56 to passage 60 at a point below socket 66. The upper end of passage 70 is connected by a flexible tube 72 to a colinear passage 74 in block 52 that leads to the top of that block. The upper end of passage 74 is, in turn, connected by a pipe or supply tube 76 to a source of working gas such as argon, or one of the other inert gases. In some cases, the working gas may also include an oxidizing gas, e.g. oxygen. We have also achieved successful results using air as a working gas, particular where the air is moist. Although the breakdown voltage associated with air is higher than that associated with argon, air tends to produce more reliable results due to the greater stability of the ionized species generated therewith.

The gas supply pressure to passage 60 is regulated by a pressure regulator 78 in supply tube 76 so as to provide a non-turbulent flow of gas to passage 60 for discharge along the exposed electrode and through the nozzle orifice 62*a*.

When the carriage 44 is positioned opposite plate 13 as shown in FIG. 3, head 56 is spaced a constant distance above the surface of the plate. This can be accomplished in any of several ways. One alternative is described in copending application Ser. No. 07/553,817, incorporated herein by reference, which describes a pneumatic sensing device and associated tracking hardware to maintain the constant spacing. Alternatively, the head 56 may be provided with a depending skirt or baffle 56*a*, with a gas passage 80 extending down from the top of head 56 into the skirt where it opens into the region within the skirt. In this embodiment, the upper end of that passage 80 is connected by a flexible tube 82 to a vertical gas passage 84 in block 52. The upper end of that latter passage is, in turn, connected to a pipe or tube 86 leading from a source of pressured air. Preferably, the tube 86 contains a flow restrictor 88 and a pressure regulator 90 so that the resultant back pressure from the air flow through the gap between the plate and the skirt 56, acting over the area encompassed by the lower edge of skirt 56*a*, is sufficient to support the head 56 at a constant distance from the surface of plate 13. Typically, the head 56 is supported so that a constant gap in the range of 0.001 to 0.015 inch is maintained between the plate 13 surface and the nozzle 62 at the underside of the head. The air discharging from passage 80 also performs other functions to be described later.

Other possible means for maintaining a constant head-to-surface distance include the use of capacitance, optical, eddycurrent or magnetic proximity-monitoring apparatus.

Still referring to FIG. 3, the writing head 56, and particularly the pulsing of electrode 64, is controlled by a pulse circuit 96. One suitable circuit comprises a transformer 98 whose secondary winding 98*a* is connected at one end by way of a fixed or variable resistor 102 to terminal 68*a* on block 52, which, as noted previously, is connected electrically to electrode 64. The opposite end of winding 98*a* is connected to electrical ground. The transformer primary winding 98*b* is connected to a DC voltage source 104 that supplies a voltage in the order of 1000 volts. The transformer primary circuit includes a capacitor 106 and a resistor 107 in series. The capacitor is maintained at full voltage by the resistor 107. An electronic switch 108 is connected in shunt with winding 98*b* and the capacitor. This switch is controlled by switching signals received from controller 50.

It should be understood that circuit 96 specifically illustrated is only one of many known circuits that can be used to provide variable high voltage pulses of short duration to electrode 64. For example, a high voltage switch and a capacitor-regenerating resistor may be used to avoid the need for transformer 98. Also, a bias voltage may be applied to the electrode 64 to provide higher voltage output pulses to the electrode without requiring a high voltage rating on the switch.

When an image is being written on plate 13, the press 10 is operated in a non-print or imaging mode with both the ink and water rollers 22*a* and 26*b* (see FIG. 1) being disengaged from cylinder 12. The imaging of plate 13 in press 10 is controlled by controller 50 which, as noted previously, also controls the rotation of cylinder 12 and the scanning of the plate by carriage assembly 42. The signals for imaging plate 13 are applied to controller 50 by a conventional source of picture signals such as a disk reader 114. The controller 50 synchronizes the image data from disk reader 114 with the control signals that control rotation of cylinder 12 and movement of carriage 44 so that when the plasma-jet source 58 is positioned over uniformly spaced image points on the plate 13, switch 108 is either closed or not closed depending upon whether that particular point is to be written on or not written on.

If that point is not to be written on, (i.e. in direct writing it corresponds to a location in the background of the original document, or in indirect writing it corresponds to a point in the image area of the document), the source electrode 64 is not pulsed and proceeds to the next image point. On the other hand, if that point in the plate does correspond to a location on the plate which is to be written on (i.e., the image area for direct writing, or the background area for indirect writing), switch 108 is closed. The closing of that switch discharges capacitor 106 so that a high voltage pulse, e.g., 1,000 volts, of only about one microsecond duration is applied to transformer 98. The transformer applies a stepped-up pulse to electrode 64, thereby causing a plasma-jet discharge J between the source tip 64*b* and plate 13. That is, each such pulse strikes a spark between the electrode tip 64*b* and plate 13 causing ionization and disassociation of the working gas molecules in passage 60, thereby creating a small diameter plasma-jet discharge through nozzle orifice 62*a* to the plate surface.

The source nozzle 62 is provided with an orifice 62*a* in the order of 0.002 to 0.010 inch in diameter to provide a sufficient flow of working gas at the regulated pressure, i.e., 1 to 4 psi, to deliver a non-turbulent plasma gas jet discharge to plate 13. This plasma discharge has sufficient momentum to function essentially as a compliant conductive path between electrode 64 and plate 13, and follows a sufficiently strong field gradient to assure substantially straight-line travel. The discharge transforms a small spot of the desired size on the surface of the plate at the image point I thereon directly opposite the nozzle orifice 62*a*. This transformation renders that point either receptive or non-receptive to ink, depending upon the type of surface on the plate.

The power of the arc actually reaching the plate (i.e., its voltage/current profile) depends on the inherent breakdown voltage associated with the working gas, the voltage (positive or negative) of the pulse applied to the electrode and the rise time of this pulse. The interplay of these variable derives from the fact that breakdown and arcing is not an instantaneous process. Although the drop in resistance that accompanies breakdown would ordinarily prevent maintenance of voltages above the breakdown threshold, a very fast rise time can momentarily impose voltage levels across the gap that exceed this threshold during the finite time required for breakdown to occur.

The current range, on the other hand, depends both on this effective arc voltage and the value of current-limiting resistor 102. Furthermore, the electrical properties of the layer of conductive material on or within the plate can limit the maximum useful current, since insufficient conductivity (e.g., due to use of too thin a layer of material for a given current level) results in charge buildup that can diminish the strength of the arc or prevent arcing entirely. Our preferred applied voltage levels—that is, the voltage actually applied to electrode 64, not the effective arc voltage—range from 1,000 to 5,000 volts; potential levels above 2,000 volts are especially preferred. As stated previously, the effective arc voltage for a given applied voltage depends on the rise time of the voltage pulse and the breakdown voltage of the working gas. Our preferred working current ranges from 0.1 to 1 amp. Lower current levels tend to be associated with easily ionized gases such as argon, and the higher levels with gases having higher breakdown voltages, such as air.

In addition to providing an air cushion for head 56 as the head is moved along the surface of plate 13, the air discharging from passage 80 into the gap between the head and the plate purges that space of debris produced by the etching or transformation process. The air is also a source of oxygen which, in the case of some plates, abets or enhances the imaging or writing by the plasma-jet source 58.

The transformations that do occur with our different lithographic plate constructions will be described in more detail later. Suffice it to say at this point that the intensity of the plasma jet is adjusted for the different plate embodiments to write thereon a clearly defined image spot on the order of 0.0001 to 0.005 inch in diameter. This may be accomplished, for example, by varying resistor 102 either manually or automatically via controller 50. Dot size may be varied by changing the voltage and/or current flow and/or duration of the pulses that produce the plasma jet discharges. Means for doing this are quite well known in the art. Dot size may also be varied within a single plate by repeated pulsing of the plasma-jet source at each image point where enlargement is desired, the number of pulses determining the dot size (pulse count modulation). The polarity of the voltage applied to the electrode 64 may be positive or negative, although preferably the polarity is selected according to whether ions need to be pulled from or repelled to the plate surface to effect the desired surface transformations on the various plates to be described.

As the plasma-jet source 58 is scanned across the plate surface, it can be pulsed at a maximum rate in excess of 100,000 pulses/sec. However, currently preferred rates are 25,000–50,000 pulses/sec. Thus, a broad range of dot densities can be achieved, e.g. 2,000 dots/inch to 50 dots/inch. The dots can be printed side-by-side or they may be made to overlap so that substantially 100% of the surface area of the plate can be imaged. Accordingly, in response to the incoming data, an image corresponding to the original document builds up on the plate surface constituted by the points or spots on the plate surface that have been transformed by the plasma-jet discharge J, as compared with the areas of the plate surface that have not been so affected by the discharge.

In the case of axial scanning, then, after one revolution of print cylinder 12, a complete image will have been applied to plate 13. The press 10 can then be operated in its printing mode by moving the ink roller 22*a* to its inking position shown in FIG. 1, and, in the case of wet printing as with plate 152 in FIG. 4B, by also shifting the water fountain roller 26*b* to its position shown in FIG. 1 and in solid lines in FIG. 2. As the plate rotates, ink will adhere only to the image points written onto the plate that correspond to the printed portion of the original document (in the case of direct writing), or the background portion (in the case of indirect writing). That ink image will then be transferred in the usual way via blanket cylinder 14 to the paper sheet P mounted to cylinder 16.

Forming the image on the plate 13 while the plate is on the cylinder 12 provides a number of advantages, the most important of which is the significant decrease in the preparation and setup time, particularly if the invention is incorporated into a multi-color press. Such a press includes a plurality of sections similar to press 10 described herein, one for each color being printed. Whereas normally the print cylinders in the different press sections after the first are adjusted axially and in rotation phase so that the different color images printed by the lithographic plates in the various press sections will appear in register on the printed copies, it is apparent from the foregoing that, since the images may be applied to the plates 13 while they are mounted in the press sections, such print registration can be accomplished electronically in the present case.

More particularly, in a multicolor press, incorporating a plurality of press sections similar to press 10, the controller 50 would adjust the timings of the picture signals controlling the writing of the images at the second and subsequent printing sections to write the image on the lithographic plate 13 in each such station with an axial and/or angular offset that compensates for any misregistration with respect to the image on the first plate 13 in the press. In other words, instead of achieving such registration by repositioning the print cylinders or plates, the registration errors are accounted for when writing the images on the plates. Thus once imaged, the plates will automatically print in perfect register on paper sheet P.

Figure 4B:
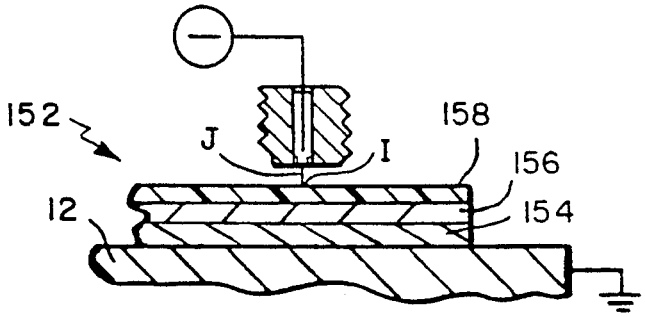

Refer now to FIGS. 4A and 4B, which illustrate two lithographic plate embodiments which are capable of being imaged by the apparatus depicted in FIGS. 1 to 3. The plate embodiment 13 in FIG. 4A is suitable for direct imaging in a press without dampening. Plate 13 comprises a substrate 132 made of a conductive metal such as aluminum or steel. The substrate carries a thin coating 134 of a highly oleophobic material such as a fluoropolymer or silicone characterized by low surface energy. One suitable coating material is an addition-cured silicone release coating marketed by Dow Corning under its designation SYL-OFF 7044. Plate 130 is written on or imaged by decomposing the surface of coating 134 using the plasma-jet discharges J from source 58. The heat from the associated arc removes the silicone coating and at least some of the metal from substrate 132 to produce an altered surface topography of enhanced ink receptivity. The discharge decomposes the silicone coating at each image point into silicon dioxide, carbon dioxide, and water; hydrocarbon fragments in trace amounts are also possible depending on the chemistry of the silicone polymers used. For other substrate materials, the presence of an oxidant in the space above image point I facilitates and abets the decomposition process.

Such decomposition and surface alterations due to the plasma-jet J renders that surface oleophilic at each image point I directly opposite the nozzle orifice 62*a*. Preferably that coating 134 is made quite thin, e.g. 0.0003 inch to minimize the voltage required to break down and remove the coating material to render the plate ink receptive. Resultantly, when plate 13 is inked by roller 22*a* in press 10, ink adheres only to those transformed image points I on the plate surface. Areas of the plate not so imaged, corresponding to the background area of the original document to be printed, do not pick up ink from roll 22*a*. The inked image on the plate is then transferred by blanket cylinder 14 to the paper sheet P as in any conventional offset press.

FIG. 4B illustrates a lithographic plate 152 that can be designed for wet or dry printing. The plate 152 comprises a substrate 154 which is oleophobic, mechanically sturdy, and resistant to extension (stretch) and heat. Polyester film meets all these requirements well and is readily available. Dupont's Mylar and ICI's Melinex are two commercially available films that are suitable for use as substrate 174. Other films that can be used are those based on polyimides (Dupont's Kapton) and polycarbonates (GE's Lexan). A preferred thickness is 0.005 inch, but thinner and thicker versions can be used effectively.

There is no requirement for an optically clear film, nor must the film surface be perfectly smooth. The use of pigmented films including films pigmented to the point of opacity are feasible for the substrate, providing mechanical properties are not lost. It is also possible to provide a resistive layer beneath substrate 154 to control overburn, as described in our copending application Ser. No. 07/410,295 (the disclosure of which is hereby incorporated by reference).

Applied to the surface of substrate 154 is a metal layer 156. This layer is important to formation of an image and must be uniformly present if uniform imaging of the plate is to occur. The image carrying (i.e. ink receptive) areas of the plate are created when the plasma-jet discharge J volatizes a portion of the thin metal layer 156. The size of the feature formed by the plasma-jet discharge from source tip 58*b* of a given energy is a function of the amount of metal that is volatized. This is, in turn, a function of the amount of metal present and the energy required to volatize the metal used. Furthermore, the thickness of this layer determines the necessary penetration depth of the plasma discharge into the plate surface.

The metal preferred for layer 156 is aluminum, which can be applied by the process of vacuum metallization (most commonly used) or sputtering to create a uniform layer 400+/−100 Angstroms thick. Because this layer is so fine, we typically gauge its thickness using conductivity measurements (e.g., with standard conductance monitors supplied by Delcom Instruments, Inc., St. Paul Park, Minn.); our preferred thickness range as specified by conductivity measurements is 0.4 to 2 mhos, with readings of 1.0 to 1.5 mhos being especially preferred. Other suitable metals include titanium, copper and zinc. In general, any metal or metal mixture, including alloys, that can be deposited on substrate 154 can be made to work, a consideration since the sputtering process can then deposit mixtures, alloys, refractories, etc. Also, the thickness of the deposit is a variable that can be expanded outside the indicated range. That is, it is possible to image a plate through a 1000 Angstrom layer of metal, and to image layers less than 100 Angstroms thick. The use of thicker layers reduces the size of the image formed, which is desirable when resolution is to be improved by using smaller size images, points or dots.

Optionally, it is possible to coat metal layer 156 with an oleophobic surface coating 158 to serve a variety of objectives. One function of such a coating can be to facilitate dry printing; a variety of silicone formulations, well-known in the art, are sufficiently oleophobic to obviate the need for dampening prior to inking. In addition, surface coating 158 can serve as a vehicle to carry conductive or semiconductive pigments that assist the imaging process, such as those disclosed in copending application Ser. No. 07/442,317 (the disclosure of which is hereby incorporated by reference).

If a silicone surface coating is added, it may also prove necessary to anchor this coating to the metal layer 156 with an additional primer layer. Effective primers include the following:

a) silanes (monomers and polymeric forms)
b) titanates
c) polyvinyl alcohols
d) polyimides and polyamide-imides.

Silanes and titanates are deposited from dilute solutions, typically 1-3% solids, while polyvinyl alcohols, polyimides, and polyamides-imides are deposited as thin films, typically less than 1 micron. The techniques for the use of these materials are well known in the art.

Suitable variations on the above-described plate designs may be found in U.S. Pat. No. 4,911,075, the disclosure of which is hereby incorporated by reference; see especially FIG. 4F thereof and the supporting discussion.

When the metal layer 156 (and, optionally, the overlying surface coating 158) is subjected to a plasma-jet discharge J from nozzle 62, it is ablated at the image point I on the surface of layer 156 directly opposite the nozzle orifice 62*a*. Accordingly, when the plate 152 is coated with water and ink by the rolls 26*b* and 22*a*, respectively, of press 10, water adheres to the image points I on plate 152 formed by the discharges J from the plasma-jet source 58. Ink, on the other hand, shuns those water-coated surface points on the plate corresponding to the background or non-printed areas of the original document and adheres only to the non-imaged areas of plate 152.

It is also feasible to replace metal layer 156 with a conductive plastic film. A suitable conductive material for layer 156 should have a volume resistivity of 100 ohm centimeters or less, Dupont's Kapton film being one example. This is an experimental film in which the normally nonconductive material has been filled with conductive pigment to create a conductive film.

All of the lithographic plates described above can be imaged on press 10 or imaged off press by means of the plasma-jet imaging apparatus described above. The described plate constructions in toto provide both direct and indirect writing capabilities and they should suit the needs of printers who wish to make copies on both wet and dry offset presses with a variety of conventional inks. In all cases, no subsequent chemical processing is required to develop or fix the images on the plates. The coaction and cooperation of the plates and the imaging apparatus described above thus provide the potential for a fully automated printing facility which can print copies in black and white or in color in long or short runs in a minimum amount of time and with a minimum amount of effort. Furthermore, the imaging system described above may be used in conjunction with convention presses (e.g., line or web presses) as well as presses specially configured for in situ plate etching.

It will thus be seen that the objects set forth above among those made apparent from the preceding description, are efficiently attained. Also, certain changes may be made in carrying out the above process, in the described products, and in the constructions set forth without departing from the scope of the invention. For example, in the case of certain plates, it may be possible to operate the plasma-jet source in a non-transferred mode in which the arc impinges the wall of the nozzle 62 which functions as an electrode (i.e. is conductive). In this event, the plasma, but not the arc, is projected as a jet beyond the nozzle to the surface of the lithographic plate. Therefore, it is intended that all matter contained in the above description or shown in the accompanying drawings shall be interpreted as illustrative and not a limiting sense.

It is also to be understood that the following claims are intended to cover all of the generic and specific features of the invention herein described.

We claim:

1. Apparatus for imaging a lithographic plate, said apparatus comprising:

a. means for supporting a lithographic plate having a printing surface whose structure gives the surface an affinity for a printing liquid selected from the group consisting of ink and water;
b. at least one plasma-jet discharge source, each of which includes a writing head comprising a nozzle and an electrode disposed behind the nozzle;
c. means for positioning the source close to the printing surface;
d. means for flowing a working gas under pressure through each nozzle to the printing surface; and
e. means for delivering high-voltage pulses in excess of 2000 volts to each electrode to produce ionized plasma-jet discharges substantially perpendicular to the printing surface without contacting the printing surface with the nozzle, said discharges being of sufficient strength to disrupt the physical structure of and remove material from said printing surface at the points thereof exposed to said discharges, thereby changing the affinity of said printing surface for said liquid at said points.

2. The apparatus defined in claim 1 wherein the electrode is fabricated of a refractory metal and terminates in a pointed tip.

3. The apparatus defined in claim 1 wherein the working gas is includes a gas that is not strongly electronegative.

4. The apparatus defined in claim 3 wherein the gas is selected from the group consisting of argon, neon, xenon, krypton and helium.

5. The apparatus defined in claim 3 wherein the working gas further comprises a relatively small proportion of an oxidizing gas.

6. The apparatus defined in claim 5 wherein the working gas is selected from the group consisting of air and moist air.

7. The apparatus defined in claim 1 wherein the ionized discharges carry current of at least 0.1 amp.

8. The apparatus defined in claim 1 wherein the nozzle focuses the discharge through a small orifice.

9. The apparatus defined in claim 1 further comprising means for varying a characteristic selected from the group consisting of voltage, current and time duration of said plasma-jet discharges for varying the sizes of the spots produced by said discharges.

10. The apparatus defined in claim 1 wherein said support means comprise the plate cylinder of a lithographic press, and further including control means for controlling the source in response to picture signals representing an image so that spots representing the image are applied to the printing surface.

11. The apparatus defined in claim 10 further including:

a. means for applying an ink to the printing surface of the plate to develop the image with ink thereon; and b. means for transferring the developed image to a recording medium.

12. The apparatus defined in claim 11 further comprising at least a second additional plate, plate cylinder and applying means for transferring an additional ink of a different color in register with the ink already applied to the recording medium.

13. Apparatus for imaging a lithographic plate, said apparatus comprising:

a. means for supporting a lithographic plate having a printing surface and including a metal layer and a second layer underlying said metal layer, said metal and second layers having different affinities for a printing liquid selected from the group consisting of water and ink;

b. at least one plasma-jet discharge source, each of which includes a writing head comprising a nozzle and an electrode disposed behind the nozzle;

c. means for positioning the source close to the printing surface;

d. means for flowing a working gas under pressure through each nozzle to the printing surface; and e. means for delivering high-voltage pulses in excess of 2000 volts to each electrode to produce ionized plasma-jet discharges substantially perpendicular to the printing surface without contacting the printing surface with the nozzle, said discharges being of sufficient strength to remove said metal layer and expose said second layer at the selected points, thereby changing the affinity of said printing surface for said liquid at said points.

14. The apparatus defined in claim 13 wherein the electrode is fabricated of a refractory metal and terminates in a pointed tip.

15. The apparatus defined in claim 13 wherein the working gas is includes a gas that is not strongly electronegative.

16. The apparatus defined in claim 15 wherein the gas is selected from the group consisting of argon, neon, xenon, krypton and helium.

17. The apparatus defined in claim 15 wherein the working gas further comprises a relatively small proportion of an oxidizing gas.

18. The apparatus defined in claim 17 wherein the working gas is selected from the group consisting of air and moist air.

19. The apparatus defined in claim 13 wherein the ionized discharges carry current of at least 0.1 amp.

20. The apparatus defined in claim 13 wherein the nozzle focuses the discharge through a small orifice.

21. The apparatus defined in claim 13 further comprising means for varying a characteristic selected from the group consisting of voltage, current and time duration of said plasma-jet discharges for varying the sizes of the spots produced by said discharges.

22. The apparatus defined in claim 13 wherein said support means comprise the plate cylinder of a lithographic press, and further including control means for controlling the source in response to picture signals representing an image so that spots representing the image are applied to the printing surface.

23. The apparatus defined in claim 22 further including:

a. means for applying an ink to the printing surface of the plate to develop the image with ink thereon; and b. means for transferring the developed image to a recording medium.

24. The apparatus defined in claim 23 further comprising at least a second additional plate, plate cylinder and applying means for transferring an additional ink of a different color in register with the ink already applied to the recording medium.

25. Apparatus for imaging a lithographic plate, said apparatus comprising:

a. means for supporting a lithographic plate having a printing surface and including an oleophobic first layer, a metal second layer underlying said first layer, and an oleophilic third layer underlying said second layer;

b. at least one plasma-jet discharge source, each of which includes a writing head comprising a nozzle and an electrode disposed behind the nozzle;

c. means for positioning the source close to the printing surface;

d. means for flowing a working gas under pressure through each nozzle to the printing surface; and e. means for delivering high-voltage pulses in excess of 2000 volts to each electrode to produce ionized plasma-jet discharges substantially perpendicular to the printing surface without contacting the printing surface with the nozzle, said discharges being of sufficient strength to remove said first and second layers at the selected points, thereby exposing said third layer.

26. The apparatus defined in claim 25 wherein the electrode is fabricated of a refractory metal and terminates in a pointed tip.

27. The apparatus defined in claim 25 wherein the working gas is includes a gas that is not strongly electronegative.

28. The apparatus defined in claim 27 wherein the gas is selected from the group consisting of argon, neon, xenon, krypton and helium.

29. The apparatus defined in claim 27 wherein the working gas further comprises a relatively small proportion of an oxidizing gas.

30. The apparatus defined in claim 29 wherein the working gas is selected from the group consisting of air and moist air.

31. The apparatus defined in claim 25 wherein the ionized discharges carry current of at least 0.1 amp.

32. The apparatus defined in claim 25 wherein the nozzle focuses the discharge through a small orifice.

33. The apparatus defined in claim 25 further comprising means for varying a characteristic selected from the group consisting of voltage, current and time duration of said plasma-jet discharges for varying the sizes of the spots produced by said discharges.

34. The apparatus defined in claim 25 wherein said support means comprise the plate cylinder of a lithographic press, and further including control means for controlling the source in response to picture signals representing an image so that spots representing the image are applied to the printing surface.

35. The apparatus defined in claim 34 further including:

a. means for applying an ink to the printing surface of the plate to develop the image with ink thereon; and b. means for transferring the developed image to a recording medium.

36. The apparatus defined in claim 25 further comprising at least a second additional plate, plate cylinder and applying means for transferring an additional ink of a different color in register with the ink already applied to the recording medium.

* * * * *